US007502007B2

(12) United States Patent
Ishii

(10) Patent No.: US 7,502,007 B2
(45) Date of Patent: Mar. 10, 2009

(54) ELECTRO-OPTICAL DEVICE, ELECTRONIC APPARATUS, AND ELECTRO-OPTICAL SHIELDING DEVICE

(75) Inventor: Kenya Ishii, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 632 days.

(21) Appl. No.: 10/916,610

(22) Filed: Aug. 12, 2004

(65) Prior Publication Data

US 2005/0068310 A1 Mar. 31, 2005

(30) Foreign Application Priority Data

Aug. 28, 2003 (JP) ..... 2003-304587

(51) Int. Cl.
*G09G 3/36* (2006.01)

(52) U.S. Cl. ..... 345/98; 345/100

(58) Field of Classification Search ..... 345/92, 345/98, 100, 204; 349/42–54, 59, 38, 39; 257/659

See application file for complete search history.

(56) References Cited

U.S. PATENT DOCUMENTS 6,433,767 B1 * 8/2002 Murade ..... 345/92
6,580,486 B1 * 6/2003 Sekine ..... 349/139
6,618,033 B2 * 9/2003 Takafuji ..... 345/96
2001/0022572 A1 * 9/2001 Murade ..... 345/98
2002/0101398 A1 * 8/2002 Fujita ..... 345/90

FOREIGN PATENT DOCUMENTS

| | | | |
|---|---|---|---|
| JP | A 06-011684 | | 1/1994 |
| JP | A 2001-021914 | | 1/2001 |
| JP | 2002049330 | * | 2/2002 |
| JP | A 2002-49052 | | 2/2002 |
| JP | A 2002-049330 | | 2/2002 |
| JP | A 2002-49331 | | 2/2002 |
| JP | A 2002-49357 | | 2/2002 |

* cited by examiner

*Primary Examiner*—Chanh Nguyen
*Assistant Examiner*—Pegeman Karimi
(74) *Attorney, Agent, or Firm*—Oliff & Berridge, PLC

(57) ABSTRACT

Exemplary embodiments of the present invention provide an electro-optical device having a sampling circuit including a plurality of thin-film transistors corresponding to respective data lines, the thin-film transistors each including i) a drain connected to a drain line extending from the data line, ii) a source connected to a source line extending from an image-signal line in the extending direction of the data line, and iii) a gate interposed between the drain line and the source line; a data-line driving circuit supplying sampling-circuit driving signals to the gate; and an electromagnetic shield disposed in a space between two adjacent thin-film transistors. This reduces the occurrence of image problems due to parasitic capacitance between the thin-film transistors in the sampling circuit.

15 Claims, 11 Drawing Sheets

ELECTRO-OPTICAL DEVICE, ELECTRONIC APPARATUS, AND ELECTRO-OPTICAL SHIELDING DEVICE

BACKGROUND OF THE INVENTION

1. Field of Invention

The present invention relates to an electro-optical device, such as a liquid-crystal device, and to an electronic apparatus, such as a liquid-crystal projector, that incorporates such an electro-optical device.

2. Description of Related Art

The related art includes, a data-line driving circuit to drive data lines, a scanning-line driving circuit to drive scanning lines, and a sampling circuit to sample image signals mounted on a substrate of an electro-optical device, such as a liquid-crystal device. During operation, in response to sampling-circuit driving signals supplied by the data-line driving circuit, the sampling circuit samples image signals supplied to image-signal lines and transmits the sampled image signals to the data lines.

To display high-definition images while limiting an increase in driving frequency, serial image signals are converted to a plurality of parallel image signals (that is, phase expansion), such as 3 phases, 6 phases, 12 phases, and 24 phases, to supply them to the electro-optical device through the plurality of image-signal lines. In this related art technique, the plurality of image signals are simultaneously sampled by a plurality of sampling switches and simultaneously supplied to the plurality of data lines.

SUMMARY OF THE INVENTION

In exemplary embodiments of the present application, a conversion of this type is referred to as a "serial-to-parallel conversion."

However, in this type of electro-optical device where a plurality of data lines are simultaneously driven, parasitic capacitance between a plurality of thin-film transistors, which serve as sampling switches included in the sampling circuit, causes interference of image signals between lines of pixels along the data lines, and thus causes image problems.

In particular, there are technical problems such that image problems, such as ghost images and cross-talk, become significant at the boundaries between groups of the data lines that are simultaneously driven. Studies conducted by the inventor of the present application show, as described below, that, in a plurality of thin-film transistors included in the sampling circuit, image problems such as ghost images are caused by parasitic capacitance between two thin-film transistors that are adjacent to each other on either side of a boundary between groups of the data lines simultaneously driven.

Exemplary embodiments of the present invention address the above and/or other problems, and provide an electro-optical device, such as a liquid-crystal device, and an electronic apparatus that are capable of reducing image problems caused by parasitic capacitance between thin-film transistors in a sampling circuit when a plurality of data lines are simultaneously driven.

An electro-optical device of exemplary embodiments of the present invention include a substrate; a plurality of scanning lines and a plurality of data lines intersecting with each other in an image display area on the substrate; a plurality of pixels connected to the plurality of scanning lines and the plurality of data lines; a plurality of image-signal lines to which image signals are supplied, the image-signal lines being located in an adjacent area of the image display area on the substrate; a sampling circuit in the adjacent area, the sampling circuit including a plurality of thin-film transistors corresponding to the respective data lines. The thin-film transistors each including i) a drain connected to a drain line extending from the data line in the extending direction of the data line; ii) a source connected to a source line extending from the image-signal line in the extending direction of the data line; and iii) a gate interposed between the drain line and the source line, and extending in the extending direction of the data line; a data-line driving circuit supplying sampling-circuit driving signals to the gate; and an electromagnetic shield disposed at least in some of spaces between two adjacent thin-film transistors.

In the electro-optical device of exemplary embodiments of the present invention, the drain line, the gate, and the source line of each thin-film transistor, which serves as a sampling switch, included in the sampling circuit extend in the extending direction of the data lines, for example, in the vertical direction, or in the Y direction. The plurality of thin-film transistors are arranged corresponding to the plurality of data lines, for example, in the horizontal direction, or in the X direction.

In operation, image signals supplied to the image-signal lines are sampled by the plurality of thin-film transistors and supplied to the plurality of data lines. On the other hand, for example, scanning signals are sequentially supplied from scanning-line driving circuits to the scanning lines. Thus, in the pixels including pixel-switching TFTs, pixel electrodes, and storage capacitance, electro-optical operation, such as liquid-crystal driving, is performed on a pixel-by-pixel basis.

Generally, due to parasitic capacitance between the adjacent thin-film transistors in the sampling circuit, potential changes in the source line and the drain line of the respective adjacent thin-film transistors affect each other and cause ghost images and cross-talk. In exemplary embodiments of the present invention, the electromagnetic shield is provided at least in some of spaces between two adjacent thin-film transistors. The electromagnetic shield is, for example, a conductive shielding line with a potential set at a fixed potential, and is arranged between adjacent two thin-film transistors. Therefore, mutual effects of potential changes via parasitic capacitance between the thin-film transistors can be reduced or prevented in an area where the electromagnetic shield is provided. Thus, virtually no ghost images and the like, due to parasitic capacitance, occurs at the data lines adjacent to each other.

Thus, according to the electro-optical device of exemplary embodiments of the present invention, high quality image display with reduced occurrence of ghost images and the like, due to parasitic capacitance between the thin-film transistors in the sampling circuit, can be addressed or achieved.

Moreover, the pitch of the thin-film transistors in the sampling circuit can be reduced while the adverse effect on image display due to parasitic capacitance is reduced or prevented. Thus, the pitches of the data lines and the pixels can also be reduced, and images can be displayed with high definition.

In the electro-optical device according to one exemplary aspect of the present invention, n image signals converted from a serial format to a parallel format are supplied to n image-signal lines, where n is a natural number greater than or equal to 2. The sampling-circuit driving signals are supplied, on a group-by-group basis, to the gates included in groups of n thin-film transistors connected to n data lines of the plurality of data lines, the n data lines being simultaneously driven by the data-line driving circuit. The electromagnetic shield is disposed at least in a space between two adjacent thin-film transistors facing each other on either side of a boundary between the groups.

In operation, according to this exemplary aspect, n image signals converted from a serial format to a parallel format (that is, phase expansion) and supplied to the n image-signal lines are sampled by groups of n thin-film transistors in the sampling circuit on a group-by-group basis and simultaneously supplied to the n data lines.

According to studies conducted by the inventor of the present application, when the n data lines are simultaneously driven, potential changes in the source lines and the drain lines of the adjacent thin-film transistors, which are connected to the n data lines and their adjacent data lines, affect each other and cause ghost images and cross-talk due to parasitic capacitance between the adjacent thin-film transistors in the sampling circuit. In particular, parasitic capacitance between adjacent groups of the thin-film transistors adversely affects displayed images. Specifically, parasitic capacitance between adjacent thin-film transistors in the same group causes ghost images and the like at the adjacent lines (that is, lines of pixels along the data lines) of a small pitch of, for example, several to tens of micrometers. In this case, ghost images and the like are virtually invisible to the human eye. On the other hand, parasitic capacitance between adjacent thin-film transistors on either side of the group boundary causes ghost images and the like that are visible to the human eye, as described below, without taking any measures.

For example, it can be assumed that only the plurality of thin-film transistors, in which arrangements of the source lines, the gates, and the drain lines are identical throughout the entire area of the sampling circuit, are arranged. In this case, the first thin-film transistor in the M-th group and the first thin-film transistor in the (M+1)-th group are connected to the same first image-signal line, where M is a natural number. Here, due to parasitic capacitance between the last thin-film transistor in the M-th group (hereinafter, "the n-th TFT") and the first thin-film transistor in the (M+1)-th group (hereinafter, "the (n+1)-th TFT"), i) potential changes in the first image-signal line are transmitted from the source line of the (n+1)-th TFT to the drain line of the n-th TFT. In this case, the potential changes corresponding to image signals on the first image-signal line, the image signals being transmitted from a source region of the (n+1)-th TFT, are added, due to the parasitic capacitance between the n-th TFT and the (n+1)-th TFT, to image signals on the n-th image-signal line to be supplied from the drain line of the n-th TFT to the data line. Or, ii) potential changes in the n-th image-signal line are transmitted from the source line of the n-th TFT to the drain line of the (n+1)-th TFT. In this case, the potential changes corresponding to image signals on the n-th image-signal line, the image signals' being transmitted from a source region of the n-th TFT, are added, due to the parasitic capacitance between the n-th TFT and the (n+1)-th TFT, to image signals on the first image-signal line to be supplied from the (n+1)-th TFT to the data line. In particular, image signals at the n-th timing in the (M+1)-th group are inputted via the n-th source in the M-th group to the first drain in the (M+1)-th group, and lead to ghost images, which are highly visible because they are separated by as much as n−1 lines from the n-th data-line in the (M+1)-th group.

In either case i) or ii), due to the parasitic capacitance between the n-th TFT and the (n+1)-th TFT, for example, white lines or black lines, depending on the contrast of the displayed images in each group, appear as ghost images and the like at the boundary between the groups. Since such ghost images and the like are separated by the width of a group of the data lines simultaneously driven, for example, by the width of several to tens of micrometers x (n-1), they are visible or highly visible to the human eye.

According to exemplary embodiments of the present invention, the electromagnetic shield is provided in the space between two adjacent thin-film transistors (that is, the n-th TFT and the (n+1)-th TFT) facing each other on either side of the group boundary, each group including n thin-film transistors simultaneously driving n data lines. Therefore, mutual effects between potential changes in the n-th TFT and the (n+1)-th TFT, via parasitic capacitance therebetween, can be reduced or prevented. Thus, parasitic capacitance between the first data line and the n-th data line facing each other on either side of the group boundary causes little or virtually no ghost image and the like.

Thus, according to the electro-optical device of the present exemplary aspect, high quality image display with reduced occurrence of ghost images and the like between groups of the data lines simultaneously driven, due to parasitic capacitance between the thin-film transistors in the sampling circuit, can be addressed or achieved. Moreover, the pitch of the thin-film transistors in the sampling circuit can be reduced while an adverse effect on image display due to parasitic capacitance is reduced or prevented. The pitches of the data lines and the pixels can thus be reduced, and images can be displayed with high definition. If the electromagnetic shield is provided only in the space between the adjacent thin-film transistors facing each other across the boundary between groups of the data lines simultaneously driven (that is, no electromagnetic shield is provided except in this position), it is more advantageous in reducing the pitches of the data lines.

According to another exemplary aspect of the electro-optical device of the present invention, the source line, the drain line, and the electromagnetic shield are formed of the same conductive layer disposed in a laminated structure on the substrate.

Since the source line, the drain line, and the electromagnetic shield are all formed from the same conductive layer made of metal, such as aluminum, which has a low wiring resistance and is suitable for wiring, the laminated structure on the substrate and the production process can be simplified. The electro-optical device of the present exemplary aspect can be easily produced, for example, by patterning the conductive layer except a portion for the electromagnetic shield. Moreover, electric line of force between the source line and the drain line can be efficiently attenuated by providing the electromagnetic shield therebetween.

According to another exemplary aspect of the electro-optical device of the present invention, the source line and the drain line are formed of the same first conductive layer disposed in a laminated structure on the substrate. The electromagnetic shield in the laminated structure has a portion formed of a second conductive layer disposed on the first conductive layer with an insulating interlayer interposed therebetween.

Thus, the wiring pitch of the source line and the drain line can be reduced, since the electromagnetic shield of a metal film made of, for example, aluminum is partially disposed on the source line and the drain line of a metal film made of, for example, another type of aluminum, with the insulating interlayer interposed therebetween. For example, the wiring pitches can be reduced to about 1.0 μm while ensuring electromagnetic shielding between the source line and the drain line. In consideration of the patterning precision, since the source line and the drain line are formed of the first conductive layer while the electromagnetic shield is partially formed of the second conductive layer, the horizontal area required for forming the source line, the drain line, and the electromagnetic shield can be reduced, compared to the case where these three are formed of the same conductive layer. Here, the risk of short circuits between the source line and the drain line, due to the presence of the electromagnetic shield, can also be reduced.

In this exemplary aspect where the electromagnetic shield includes a portion formed of the second conductive layer, the electromagnetic shield may at least partially cover the source line and the drain line from above the insulating interlayer.

Thus, the electromagnetic shield disposed above the source line and the drain line can more effectively shield the electric line of force generated therebetween.

In this exemplary aspect where the electromagnetic shield includes a portion formed of the second conductive layer, the second conductive layer is also formed in a hole provided in the insulating interlayer and isolated from the source line and the drain line.

Thus, the electromagnetic shield formed in the hole provided between the source line and the drain line can more effectively shield the electric line of force generated therebetween. Moreover, since the hole is isolated from the source line and the drain line, the risk of short circuits between the source line and the drain line, due to the presence of the electromagnetic shield, can also be reduced. Such hole may be a hole that is circular or rectangular in plan view, or may be a long slot or a groove extending in the extending direction of the data lines.

According to another exemplary aspect of the electro-optical device of the present invention, the source line and the drain line are formed of the same first conductive layer disposed in a laminated structure on the substrate. The electromagnetic shield in the laminated structure has a portion formed of a second conductive layer disposed under the first conductive layer with insulating interlayers interposed therebetween.

Since the electromagnetic shield of a metal film made of, for example, metal with a high melting point is disposed below the source line and the drain line of a metal film made of, for example, aluminum, with the insulating interlayers interposed therebetween, the wiring pitch of the source line and the drain line can be reduced. For example, the wiring pitch can be reduced to about 1.0 μm while ensuring electromagnetic shielding between the source line and the drain line. In consideration of the patterning precision, since the source line and the drain line are formed of the first conductive layer while the electromagnetic shield is formed of the second conductive layer, the horizontal area required for forming the source line, the drain line, and the electromagnetic shield can be reduced, compared to the case where these three are formed of the same conductive layer. Here, the risk of short circuits between the source line and the drain line, due to the electromagnetic shield, can also be reduced.

Such second conductive layer is formed of, for example, the same layer as a lower conductive film for at least partially shielding a non-aperture area in each pixel of the electro-optical device.

According to another exemplary aspect of the electro-optical device of the present invention, the electromagnetic shield is connected to lines of constant potential. Since the electromagnetic shield is connected to lines of constant potential, desirable electromagnetic shielding properties can be obtained.

Even if the electromagnetic shield is at floating potential, a certain shielding effect can still be addressed or achieved depending on the level of capacitance of the electromagnetic shield. If the potential changes are in synchronization with the driving period of image signals, a certain shielding effect can be obtained even if the electromagnetic shield has a rectangular wave of potential ranging between fixed potentials.

According to this exemplary aspect, the lines of constant potential may include a line of ground potential supplied to the data-line driving circuit.

In this configuration, the potential of the electromagnetic shield can be set at a very stable constant potential. Extremely desirable electromagnetic shielding properties can thus be addressed or achieved. Incidentally, if the potential of the electromagnetic shield is set at the potential of a capacitive line for applying storage capacitance to a pixel electrode, ghost images in the form of blocks may appear. Therefore, use of a ground potential supplied to the data-line driving circuit, which generally has a stable potential, is advantageous. In this case, the data-line driving circuit is normally arranged adjacent to the sampling circuit. This is advantageous in terms of layout on the substrate.

According to another exemplary aspect of the electro-optical device of the present invention, the electromagnetic shield is connected to lines of variable potential periodically changing in response to inversion driving.

Since the electromagnetic shield is connected to lines of variable potential periodically changing in response to inversion driving, desirable electromagnetic shielding properties can be addressed or achieved. That is, desirable electromagnetic shielding properties can be obtained since the potential of the electromagnetic shield changes in synchronization with the driving period of image signals and is stable during the sampling of each image signal.

According to another exemplary aspect of the electro-optical device of the present invention, the electromagnetic shield is connected to the gate.

Since the electromagnetic shield is connected to the gates, desirable electromagnetic shielding properties can be addressed or achieved. That is, desirable electromagnetic shielding properties can be obtained since the potential of the electromagnetic shield changes in synchronization with the driving period of image signals and is stable during the sampling of each image signal.

According to another exemplary aspect of the electro-optical device of the present invention, the electromagnetic shield between the two adjacent thin-film transistors is formed in a position for at least partially shielding the shortest electric line of force connecting the source line to the drain line adjacent to each other.

Electromagnetic shielding properties can be efficiently addressed or achieved since the electromagnetic shield electromagnetically shields the shortest electric line of force connecting the source line to the drain line, that is, a region where the electric field intensity is highest.

The electro-optical device of exemplary embodiments of the present invention can thus display high quality images with reduced occurrence of ghost images and the like, and high definition images. Applications of the electro-optical device of the present invention include a liquid-crystal device, an electrophoresis unit such as electronic paper, and a field emission display and a surface-conduction electron-emitter display that include electron-emitting elements.

To address or solve the problems described above, the electronic apparatus of exemplary embodiments of the present invention include the above-described electro-optical device according to exemplary embodiments of the present invention.

The electronic apparatus of the present invention can be used as a variety of electronic apparatuses capable of displaying high quality images, such as projection displays, television receivers, mobile phones, electronic notepads, word processors, viewfinder-type or monitor-direct-view-type videotape recorders, workstations, videophones, point-of-sale (POS) terminals, and touch panels.

DETAILED DESCRIPTION OF PREFERRED EMBODIMENTS

Exemplary embodiments of the present invention will now be described with reference to the drawings. In the following exemplary embodiments, the electro-optical device of the present invention is applied to a liquid-crystal device.

First Exemplary Embodiment

FIGS. 1 to 4 illustrate a liquid-crystal device as a first exemplary embodiment of the electro-optical device according to the present invention.

<Structure of Display Panel>

Figure 1:
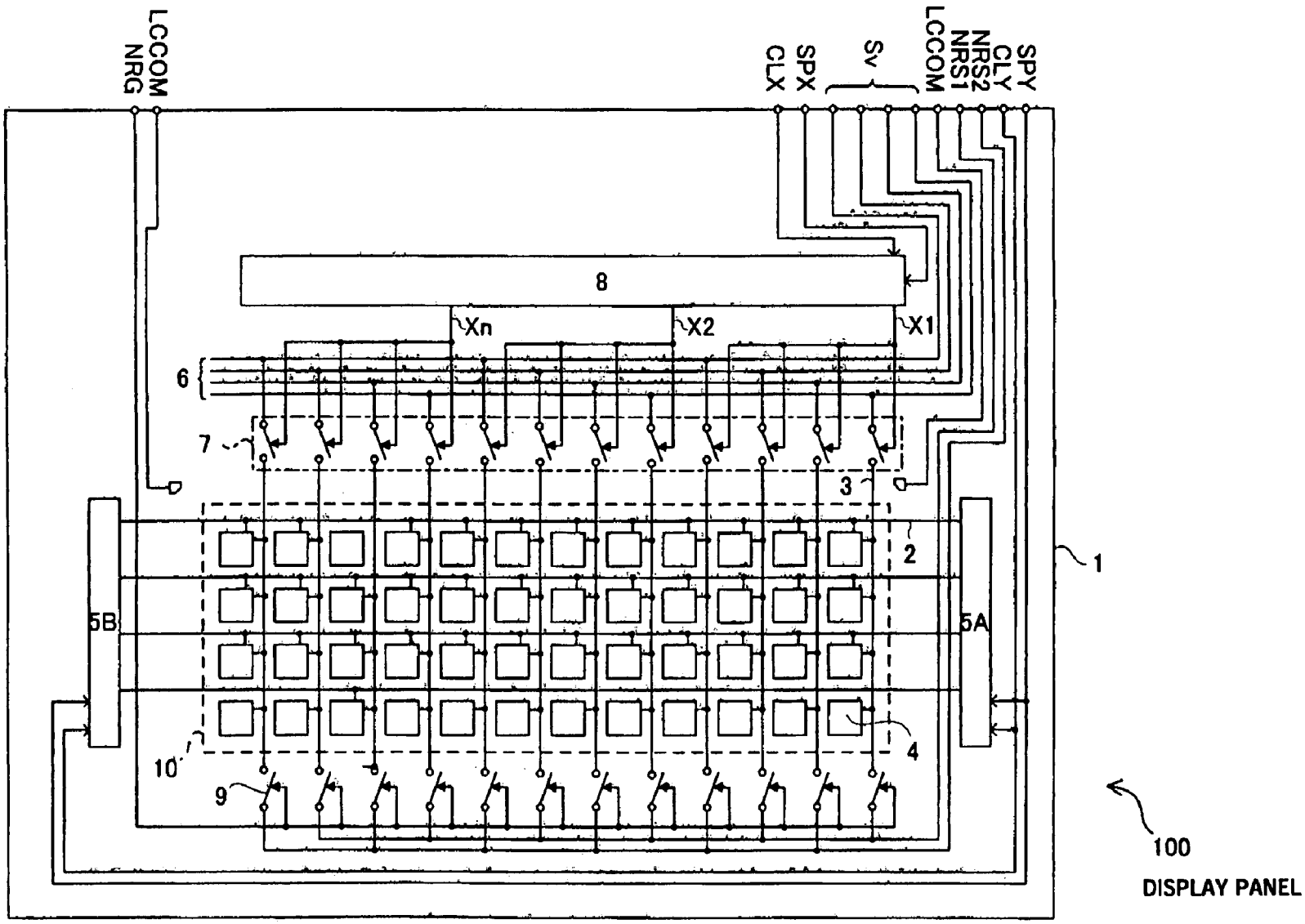
FIG. 1 is a schematic block diagram showing a display panel of an electro-optical device according to a first exemplary embodiment of the present invention.

FIG. 1 is a schematic that shows the structure of a display panel included in the liquid-crystal device of the present exemplary embodiment. This liquid-crystal device includes a display panel 100 with integrated driving circuits and circuitry (not shown) dealing with overall driving control and various processing of image signals.

In the display panel 100, a TFT-array substrate 1 and a counter substrate (not shown) are arranged opposite to each other with a liquid-crystal layer interposed therebetween. To display grayscale images, an electric field is applied to the liquid-crystal layer, on the basis of each element of a matrix of pixels 4 in an image-display area 10, to control the amount of light passing through both the substrates. In the display panel 100 of the liquid-crystal device employing TFT active matrix technology, a plurality of scanning lines 2 and a plurality of data lines 3 intersect in the image-display area 10 on the TFT-array substrate 1. The pixels 4 are connected to the scanning lines 2 and the data lines 3. Each pixel 4 basically includes a thin-film transistor for pixel switching to selectively apply an image-signal voltage supplied by the data line 3, and a pixel electrode to apply an input voltage to the liquid-crystal layer and maintaining it, that is, to form a liquid-crystal-retaining capacitance together with a counter electrode.

The scanning lines 2 are connected, for example, at both ends to respective scanning-line driving circuits 5A and 5B that sequentially select and drive the scanning lines 2. The scanning-line driving circuits 5A and 5B are provided in the area around the image-display area 10 and simultaneously apply a voltage to both ends of each scanning line 2.

The data lines 3 are connected via a sampling circuit 7 to image-signal lines 6 that supply image signals Sv. The sampling circuit 7 includes switching elements, each being attached to a corresponding data line 3 to select the data lines 3 receiving image signals Sv from the image-signal lines 6. A data-line driving circuit 8 controls the timing of the switching operation performed by the switching elements. A precharge circuit 9 is provided to apply a precharge-level voltage to the data lines 3 prior to the application of the image signals Sv to the data lines 3.

The display panel 100 is configured to be driven through "serial-to-parallel conversion." In other words, as illustrated in FIG. 1, the plurality of image-signal lines 6 (four image-signal lines 6 here) are arranged, and the data lines 3 (four data lines 3), each being connected to one of the image-signal lines 6 in the order of arrangement, are grouped together. The switching elements corresponding to the data lines 3 are connected via control lines X (X1, X2, . . . ) to the data-line driving circuit 8 in groups. Then, pulses sequentially outputted from a shift register in the data-line driving circuit 8 are sequentially inputted, as sampling-circuit driving signals, via the control lines X1, X2, . . . , to the sampling circuit 7. Here, the plurality of switching elements grouped together and connected to the same control line X are simultaneously driven. Therefore, image signals on the image-signal lines 6 are sampled on a group-by-group basis of the data lines 3. Thus, when parallel image signals obtained by conversion of serial image signals are simultaneously supplied to the plurality of image-signal lines 6, the driving frequency can be reduced since image signals can be inputted to the data lines 3 on a group-by-group basis.

<Sampling Circuit>

Figure 2:
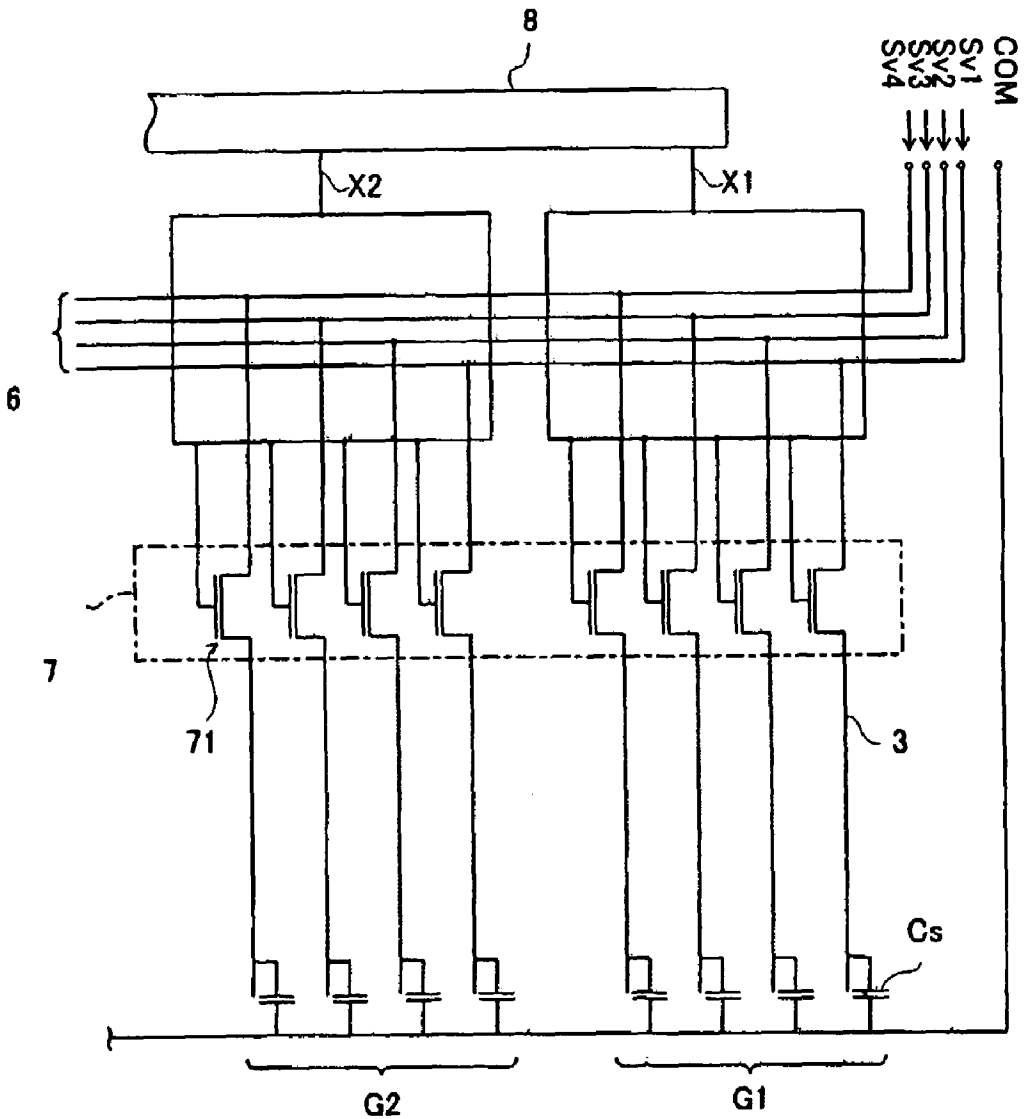
FIG. 2 is a circuit diagram showing the configuration of a data-line driving circuit system in the display panel in FIG. 1.

FIG. 2 shows a circuit system, in the display panel, to drive the data lines. For ease of explanation, FIG. 2 illustrates only circuit systems for groups G1 and G2 of the data lines 3 that are connected to the control lines X1 and X2, respectively. The detailed description below will also be based on the circuit systems for these two groups.

Here, image signals Sv1 to Sv4 are supplied to the respective four image-signal lines 6. Switching elements of the sampling circuit 7 are sampling TFTs 71, in particular. Each of the sampling TFTs 71 and the data lines 3 are connected in series between a source and a drain, while a gate is connected to the data-line driving circuit 8. Each of the data lines 3 is connected, at the end remote from the sampling circuit 7, to many pixels 4 to supply a signal voltage to a liquid-crystal capacitance Cs of a selected pixel 4. A storage capacitance may be connected in parallel with the liquid-crystal capacitance Cs.

Figure 3:
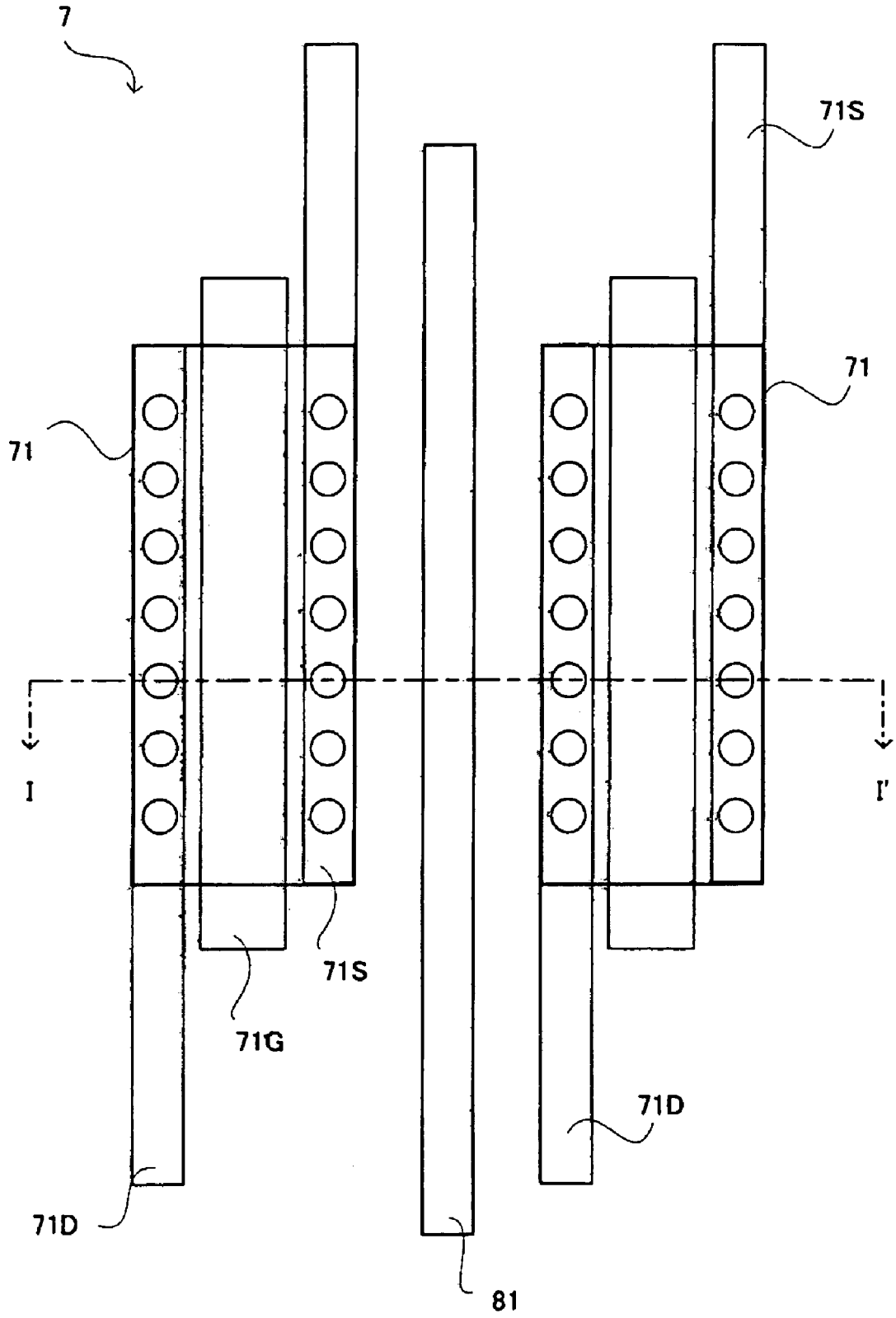
FIG. 3 is a schematic showing a wiring layout of a sampling circuit in FIG. 2.

FIG. 3 is an enlarged partial plan view of the sampling circuit 7, in which many sampling TFTs 71 are arranged in parallel in the direction orthogonal to the extending direction of the data lines 3. Each sampling TFT 71 includes a source line 71S and a drain line 71D, which extend in the extending direction of the data lines 3, and a gate line 71G extending therebetween. In the present exemplary embodiment, an electromagnetic shield 81 is provided at least in some of the regions between the sampling TFTs 71 adjacent to each other. This reduces the parasitic capacitance between the adjacent sampling TFTs 71. Therefore, when the sampling TFTs 71 are driven, effects of potential changes in the source line 71S, via the parasitic capacitance, on the potential of the drain line 71D are reduced, while effects of potential changes in the drain line 71D, via the parasitic capacitance, on the potential of the source line 71S are also reduced.

Figure 4:
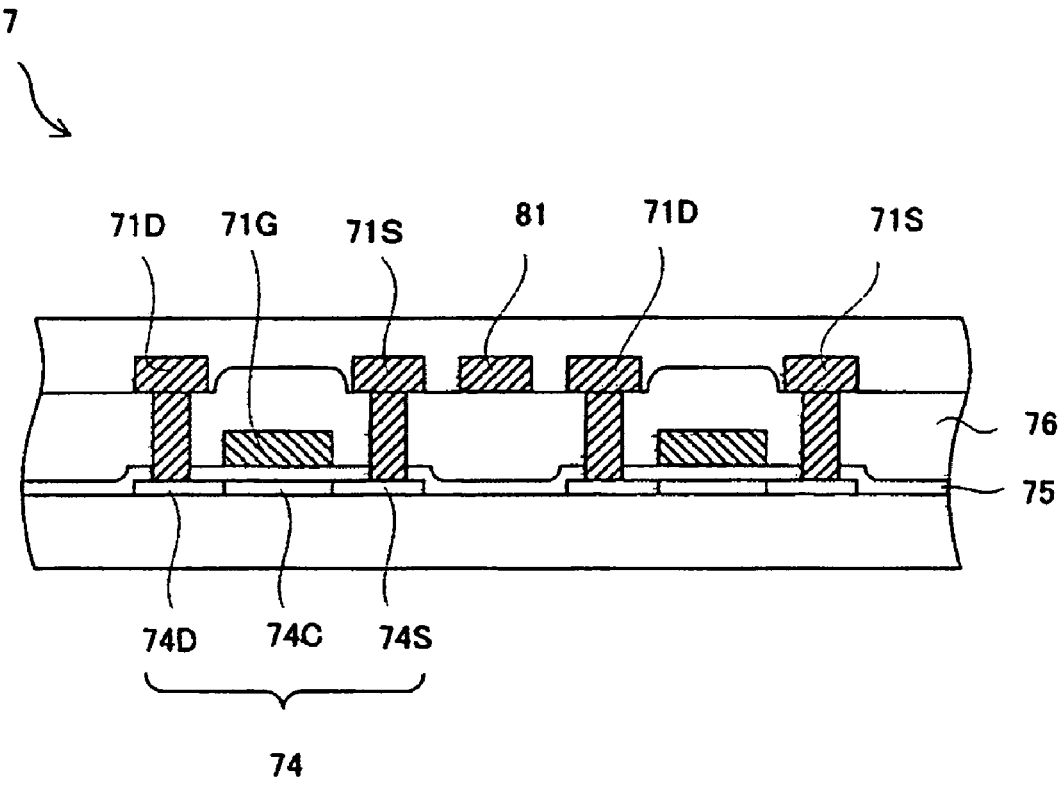
FIG. 4 is a schematic cross-sectional view taken along line I-I' in FIG. 3.

FIG. 4 is an enlarged view taken along line I-I' in FIG. 3 and showing a cross-sectional structure of the sampling TFT 71. In the sampling TFT 71, for example, a source region 74S and a drain region 74D of a semiconductor layer 74 disposed on the TFT-array substrate 1 are connected to the source line 71S and the drain line 71D, respectively. The gate line 71G is disposed on a channel region 74C with a gate insulating film 75 interposed therebetween, thereby forming a gate. The source line 71S, the gate line 71G, and the drain line 71D are electrically insulated from one another by an insulating interlayer 76.

Here, the source line 71S, the drain line 71D, and the electromagnetic shield 81 are formed on a surface of the insulating interlayer 76. They can be produced by patterning the same conductive layer into the form illustrated in FIG. 3. The conductive layer is preferably, for example, a thin film made of metal such as aluminum. The electromagnetic shield 81 faces both the source line 71S and the drain line 71D of the adjacent sampling TFTs 71, since they are formed on the same surface. In other words, since the electromagnetic shield 81 is disposed in a position to shield the shortest electric line of force generated between the source line 71S and the drain line 71D, that is, in a region where the electric field intensity is highest, the electromagnetic shield 81 can efficiently shield the electromagnetic field.

The electromagnetic shield 81 is preferably connected to constant potential lines to achieve desirable electromagnetic shielding properties. While, for example, capacitive lines to apply storage capacitance to pixel electrodes may be selected as the constant potential lines, ground potential is preferably used because the capacitive lines may cause ghost images in the form of blocks. Extremely desirable electromagnetic shielding properties can be addressed or achieved by setting the potential of the electromagnetic shield 81 at a very stable ground potential. Specifically, when the electromagnetic shield 81 is connected to a ground line to ground the data-line driving circuit, the data-line driving circuit is normally arranged adjacent to the sampling circuit. This is advantageous in terms of layout on the substrate. Even if connection to lines is difficult to implement, certain effects of electromagnetic shielding can be addressed or achieved by floating the electromagnetic shield 81 to maintain floating potential.

<Operation of Display Panel>

In the display panel 100, when image signals Sv are supplied to each data line 3 during one period of horizontal scanning, the data-line driving circuit 8 sequentially inputs control signals to the control lines X1, X2, . . . at a predetermined timing, thereby controlling the ON/OFF state of the sampling TFTs 71 on a group-by-group basis. In synchronization with this sampling control, image signals Sv1 to Sv4 corresponding to each data line 3 in a group where the sampling circuit 7 is in the ON state and signal input is permitted are sampled on the image-signal lines 6 and simultaneously supplied to the corresponding four data lines 3.

In the adjacent sampling TFTs 71, parasitic capacitance exists between the lines that function as capacitive electrodes because they face each other with the insulating interlayer 76, which serves as a dielectric film, therebetween. Such parasitic capacitance is particularly large between the most adjacent lines. The parasitic capacitance also increases as image definition increases, because the thickness of the dielectric film is reduced as the pitch of pixels and the distance between the sampling TFTs 71 decrease. In the group G1 during operation, potential changes mainly in the source line 71S and the drain line 71D affect each other depending on the level of parasitic capacitance connected to the lines in the group G1. Therefore, potential changes caused by image signals other than the image signals originally supplied to the pixels 4 as well as the data lines 3 occur. These potential changes all might cause ghost images in the strict sense.

Since, in the present exemplary embodiment, the electromagnetic shield 81 is provided between the most adjacent lines (between the source line 71S and the drain line 71D) to shield the electric field, the parasitic capacitance and noise are reduced, and a proper amount of voltage is applied to the pixels 4. Thus, high quality image display with little or no appearance of ghost images and the like can be addressed or achieved.

By reducing the parasitic capacitance, moreover, a line pitch of the sampling TFTs 71, which is in a trade-off relationship with respect to the reduction of parasitic capacitance, can be reduced without sacrificing image quality. The display panel 100 can thus display images with high definition compared to known examples.

Second Exemplary Embodiment

A second exemplary embodiment will now be described with reference to FIGS. 5 to 8.

The main structure of an electro-optical device of the second exemplary embodiment, other than the layout of a sampling circuit and the structure of an electromagnetic shield, is basically the same as that of the first exemplary embodiment. Therefore, the same components as those in the first exemplary embodiment are given the same reference numerals and their descriptions will be appropriately omitted.

Figure 5:
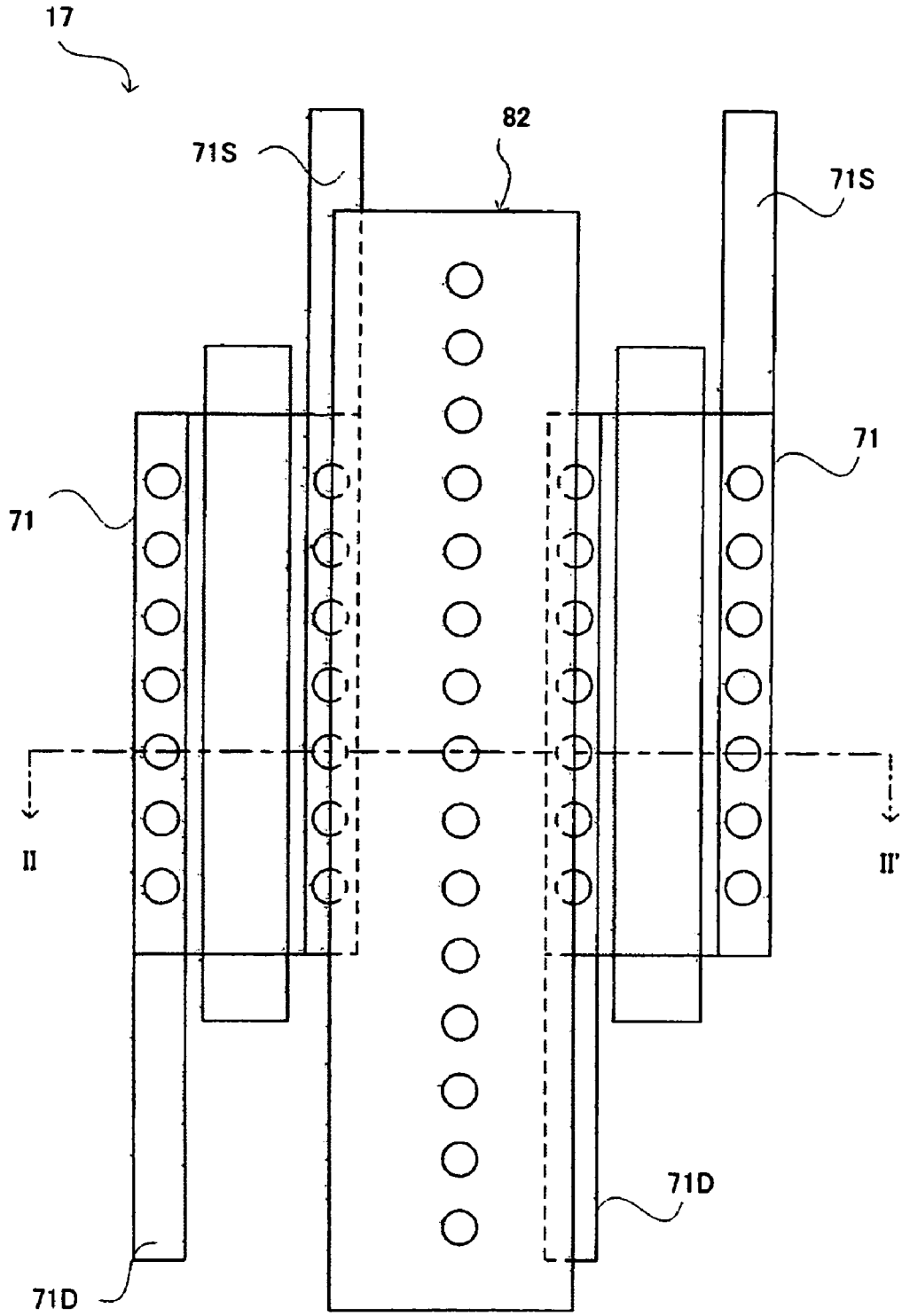
FIG. 5 is a schematic showing a wiring layout of a sampling circuit in an electro-optical device according to a second exemplary embodiment.
Figure 6:
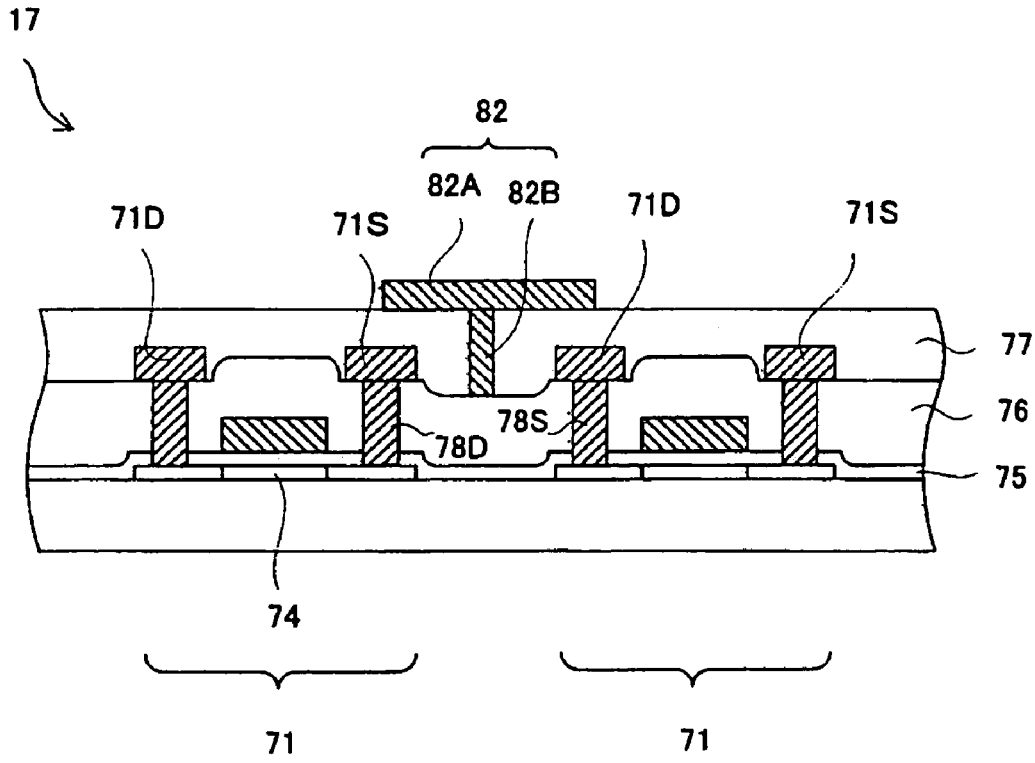
FIG. 6 is a schematic cross-sectional view taken along line II-II' in FIG. 5.

FIG. 5 is a schematic that shows the structure of a part of a sampling circuit according to the second exemplary embodiment. FIG. 6 is a schematic cross-sectional view taken along line II-II' in FIG. 5. In a sampling circuit 17, an electromagnetic shield 82 is disposed between the adjacent sampling TFTs 71.

Figure 7:
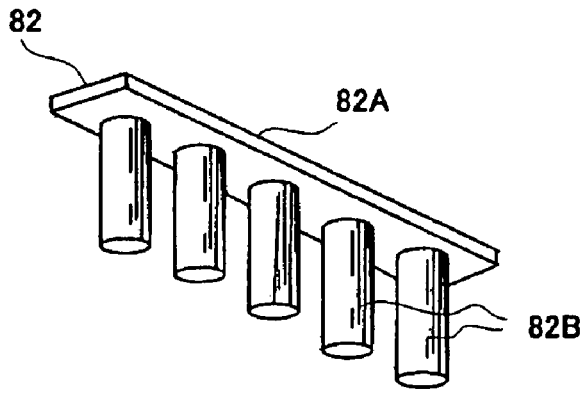
FIG. 7 is a schematic perspective view showing the structure of an electromagnetic shield in FIG. 5.

The electromagnetic shield 82 includes an upper layer 82A and protrusions 82B. FIG. 7 is an oblique bottom view of the electromagnetic shield 82. The upper layer 82A is disposed on the insulating interlayer 77, which is disposed on the source line 71S and the drain line 71D formed of the same conductive layer. The upper layer 82A shields the electric field generated above the area between the source line 71S and the drain line 71D. The protrusions 82B are cylindrical electric conductors formed in the holes that are provided in the insulating interlayer 77 and are not connected to either the source line 71S or the drain line 71D. The protrusions 82B are arranged in the extending direction of the upper layer 82A at the same intervals as those of, for example, wiring parts 78S and the wiring parts 78D, which are provided for connecting the source line 71S and the drain line 71D to a semiconductor layer 74.

The sizes of the protrusions 82B, which are formed between the source line 71S and the drain line 71D, depend on the processing precision of the holes provided in the insulating interlayer 77. The protrusions 82B are not limited to cylinders, but may be, for example, shaped like square columns. In the electromagnetic shield 82, for example, the upper layer 82A and the protrusions 82B are both made of metal, such as aluminum.

Since electrode wiring and the electromagnetic shield 82 are provided on different surfaces in the present exemplary embodiment, the wiring pitches can be reduced while the shielding effect is obtained. That is, in consideration of the patterning precision, the wiring pitch between the source line 71S and the drain line 71D can be reduced, compared to the electromagnetic shield 81 in the first exemplary embodiment.

In addition, since the upper layer 82A at least partially covers the drain line 71D and the source line 71S from the top, the electromagnetic shield 82 effectively shields the electric field particularly on the upper side. Thus, the parasitic capacitance between the adjacent sampling TFTs 71 is efficiently reduced, thereby addressing or achieving high quality image display with little or no appearance of ghost images and the like.

(Exemplary Modification)

Figure 8:
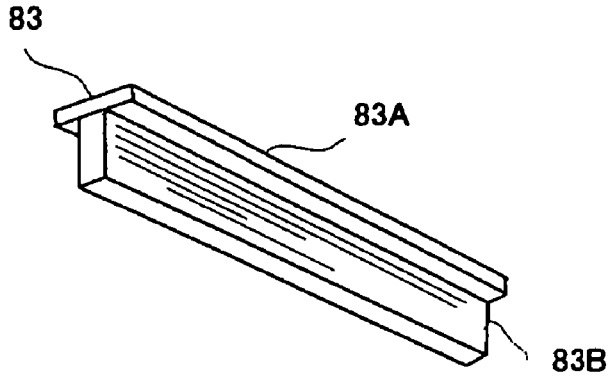
FIG. 8 is a schematic perspective view showing the structure of an electromagnetic shield according to a modification of the second exemplary embodiment.

FIG. 8 is a schematic that shows an electromagnetic shield according to an exemplary modification of the second exemplary embodiment. An electromagnetic shield 83 includes an upper layer 83A and a protruding plate 83B. The cross-sectional structure of a sampling circuit of this exemplary modification is, similarly to the second exemplary embodiment, as shown in FIG. 6. This protruding plate 83B is made, for example, by filling a groove, which is formed in a predetermined position of the insulating interlayer 77, with conductive material.

Third Exemplary Embodiment

A third exemplary embodiment will now be described with reference to FIG. 9.

The main structure of an electro-optical device of the third exemplary embodiment, other than the layout of a sampling circuit and the structure of an electromagnetic shield, is basically the same as that of the first exemplary embodiment. Therefore, the same components as those in the first exemplary embodiment are given the same reference numerals and their descriptions will be appropriately omitted.

Figure 9:
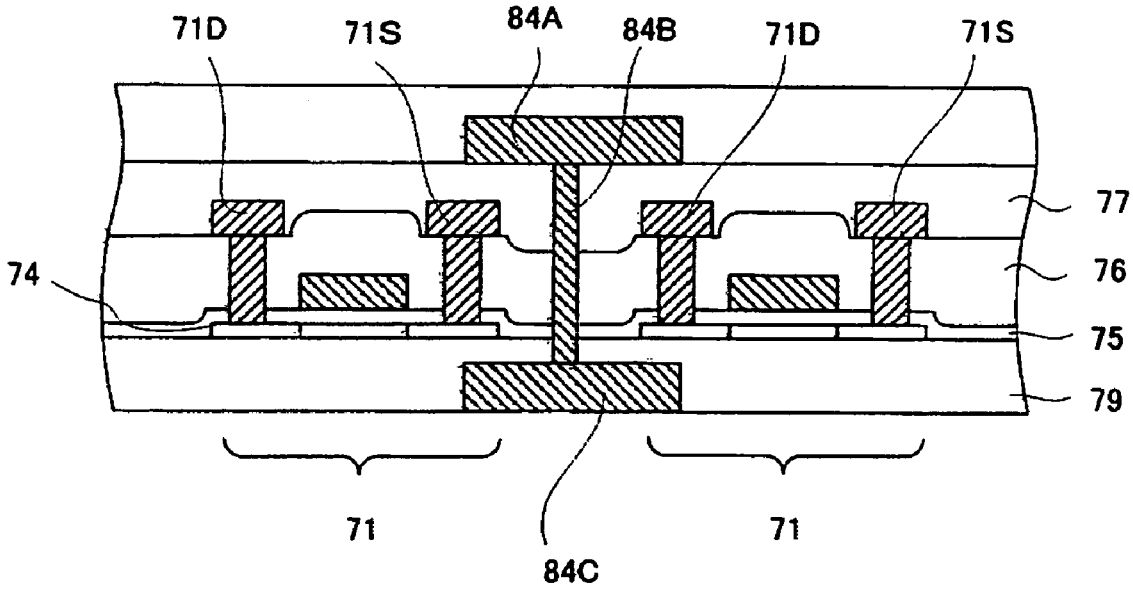
FIG. 9 is a schematic cross-sectional view showing the structure of a sampling circuit according to a third exemplary embodiment.

FIG. 9 is a schematic that partially shows a cross-sectional structure of a sampling circuit according to the third exemplary embodiment. In a sampling circuit 27, an electromagnetic shield 84 shaped like the letter "I" in cross-section is disposed between the sampling TFTs 71 adjacent to each other.

The electromagnetic shield 84 includes an upper layer 84A, a center portion 84B, and a lower layer 84C. The upper layer 84A may be structured as the upper layer 82A of the second exemplary embodiment. The lower layer 84C is disposed below the source line 71S and the drain line 71D and the insulating interlayers. Here, the lower layer 84C is disposed directly under the insulating interlayer 79. The upper layer 84A and the lower layer 84C are provided for shielding the electric fields on the upper side and the lower side, respectively.

While the upper layer 84A and the lower layer 84C may be, for example, identical in size, they preferably have sizes suitable for shielding and are formed in positions according to the distribution of the electric fields between the source line 71S and the drain line 71D facing each other. While the lower layer 84C may be formed separately from other conductive layers, the lower layer 84C and the light-shielding conductive layers here are formed out of the same layer, which is made of, for example, light-blocking metal with a high melting point, such as chromium, titanium, and tungsten.

The center portion 84B connecting the upper layer 84A to the lower layer 84C is disposed between the source line 71 and the drain line 71D. The center portion 84B is a wall penetrating through the insulating interlayer 77 to reach the insulating interlayer 79, thereby almost completely shielding the electric field generated between the source line 71S and the drain line 71D when the display panel 100 is driven.

In the present exemplary embodiment, the electric field generated between the source line 71S and the drain line 71D when the display panel 100 is driven is almost completely shielded by the center portion 84B of the electromagnetic shield 84. Moreover, the electric fields on the upper side and the lower side are also shielded by the upper layer 84A and the lower layer 84C, respectively. Effects of electromagnetic shielding are thus efficiently addressed or achieved. The parasitic capacitance between the adjacent sampling TFTs 71 is efficiently reduced, thereby addressing or achieving high quality image display with little or no occurrence of ghost images and the like. If at least one of the upper layer 84A, the center portion 84B, and the lower layer 84C is provided, the effect of reducing the parasitic capacitance is significant compared to the case when no electromagnetic shield is provided. That is, an electromagnetic shield including any one or two of the upper layer 84A, the center portion 84B, and the lower layer 84C is also within the technical scope of the present invention that has the original effect disclosed in the present exemplary embodiment.

Fourth Exemplary Embodiment

A fourth exemplary embodiment will now be described with reference to FIG. 10.

The main structure of an electro-optical device of the fourth exemplary embodiment, other than the layout of a sampling circuit and the structure of an electromagnetic shield, is basically the same as that of the first exemplary embodiment. Therefore, the same components as those in the first exemplary embodiment are given the same reference numerals and their descriptions will be appropriately omitted.

Figure 10:
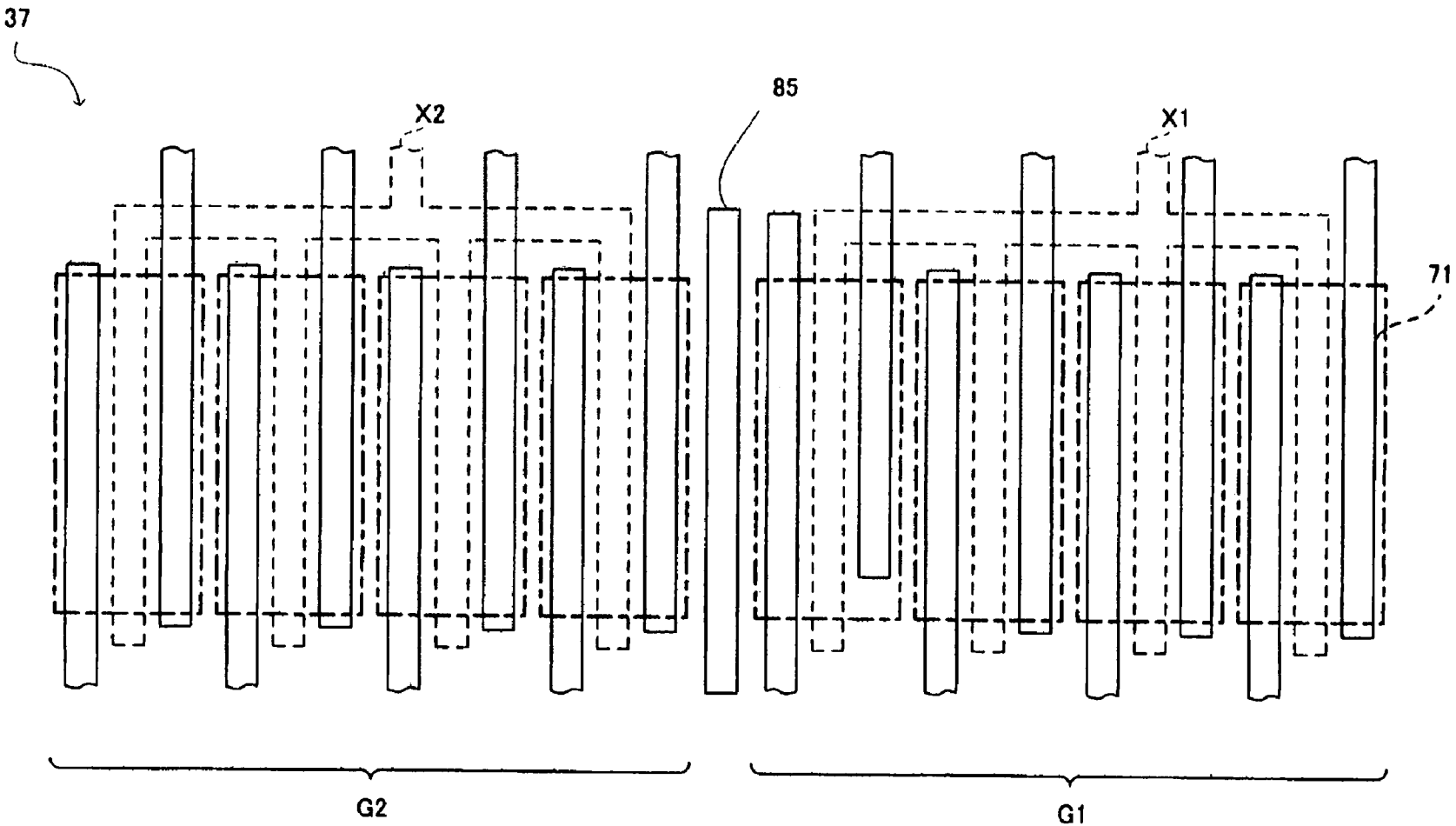
FIG. 10 is a schematic showing a wiring layout showing the configuration of a sampling circuit according to a fourth exemplary embodiment.

FIG. 10 is a partial schematic plan view showing the structure of the sampling circuit according to the fourth exemplary embodiment. In a sampling circuit 37, an electromagnetic shield 85 is disposed between the groups (G1, G2, . . . ) of the sampling TFTs 71 bounded by the control lines X (X1, X2, . . . ) (see, FIG. 1 or FIG. 2). The electromagnetic shield 85 is identical to the electromagnetic shield 81 of the first exemplary embodiment except that the electromagnetic shield 85 is provided between the groups only.

As described above, in the sampling TFTs 71 adjacent to each other, parasitic capacitance exists between the lines that function as capacitive electrodes, and potential changes mainly in the adjacent source line 71S and drain line 71D affect each other. However, the parasitic capacitance between the sampling TFTs 71 belonging to different groups and facing on either side of the boundary between groups (hereinafter, referred to as "intergroup capacitance") more significantly affects the image quality than the parasitic capacitance between the sampling TFTs 71 in the same group.

Normally, images are not significantly different on a pixel-by-pixel basis, and adjacent pixels display similar images. In other words, as adjacent pixels come closer together, the voltage difference between pixel signals is reduced. Therefore, potential changes between adjacent lines in the same group, due to parasitic capacitance, are basically small. Even if images are significantly different on a pixel-by-pixel basis, particularly between adjacent pixels, and even if the parasitic capacitance between the adjacent sampling TFTs 71 cause ghost images to appear between pixel lines connected to the adjacent data lines, it is rather difficult to view the ghost images. For example, even if a black line or a white line appears near the boundary between a white image or a black image, the thin black or white line deviated by a line of several tens of micrometers is virtually invisible.

However, for example, during the period when image signals are to be supplied to the group G1, potential changes in the source line 71S, which is directly connected to the image-signal line 6, bypass the channel regions in the OFF state in all the TFTs and are transmitted from one end of the group G1 via the intergroup capacitance to the adjacent drain line 71D in another group. Or, during the period when image signals are to be supplied to the group G1, potential changes in the source line 71S in an adjacent group, the source line 71S being directly connected to the image-signal line 6, are transmitted via the intergroup capacitance to the drain line 71D at the other end of the group G1, image signals being supplied to the drain line 71D from the image-signal line 6. In this case, for example, when the image signals Sv for displaying the pixels 4 in black at the right end of the group G1 are supplied, the pixels 4 at the left end were displayed in white. This is caused by parasitic capacitance, which effectively reduces the voltage applied to the pixels 4 at the left end in response to the image signals Sv.

Since the potential of the data line 3 at one end of a group affects the potential of the data line 3 at the other end due to intergroup capacitance, the resulting effects appear in the pixels that are separated by the width of the group. They are far more visible compared to noise generated between adjacent pixels. Thus, adverse effects of the intergroup capacitance appear as significant ghost images and become highly visible to the human eye.

Since, in the present exemplary embodiment, the electromagnetic shield 85 between the groups specifically reduces the parasitic capacitance therebetween, images with little or no image degradation, due to ghost images and the like, can be efficiently displayed. Here, intergroup capacitance, which is particularly large, can be reduced and image quality can be dramatically enhanced or improved by only partially modifying the layout of a known sampling circuit.

In the present exemplary embodiment, the configuration of the electromagnetic shield 85 is the same as that of the electromagnetic shield 81. Other configurations, such as those of the electromagnetic shields 82 to 84, which are formed between the groups of the sampling TFTs 71, as described in the above exemplary embodiments, may also be applied.

[Electronic Apparatus]

Applications of the above-described electro-optical device to various electronic apparatuses will now be described.

(Projector)

Figure 11:
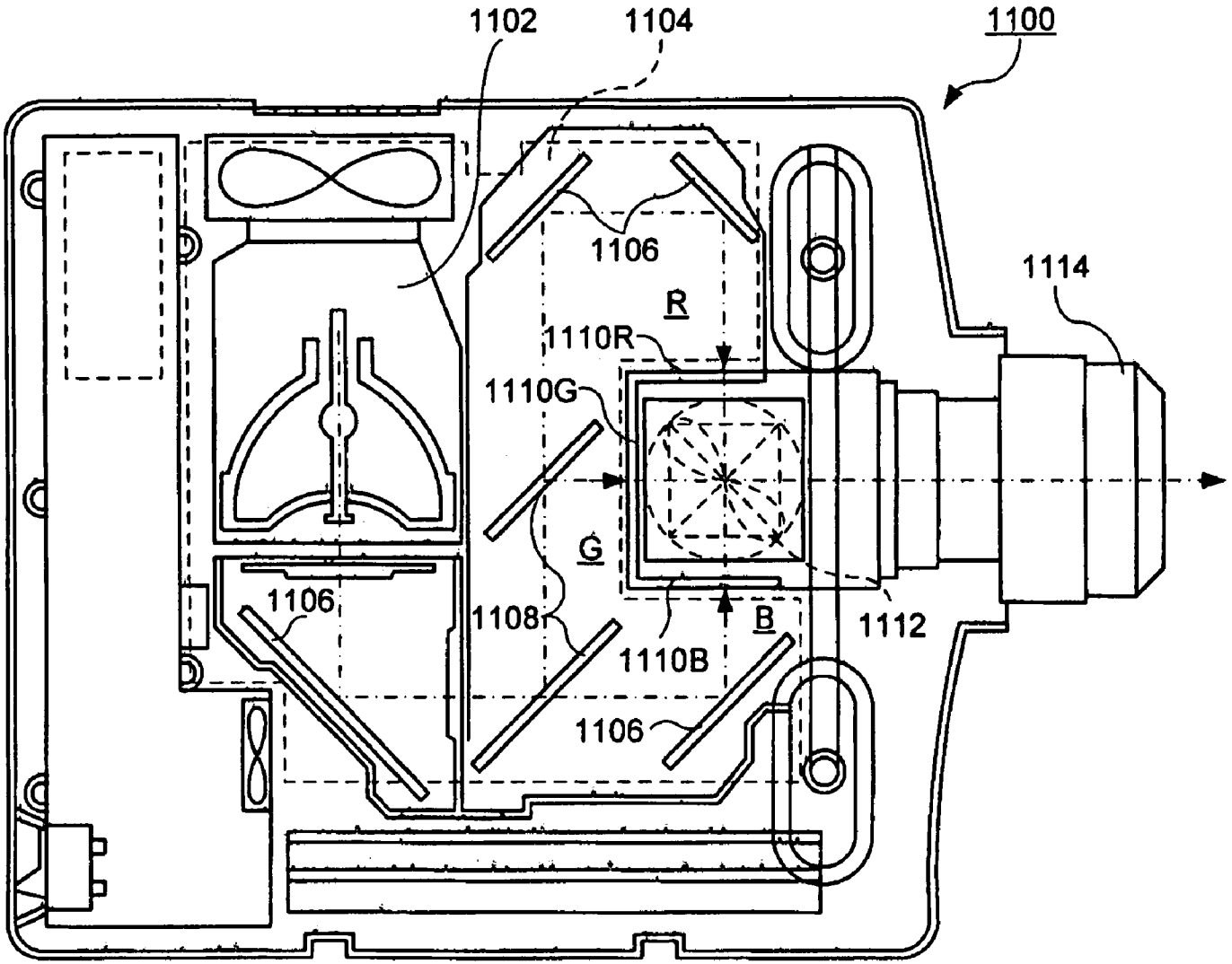
FIG. 11 is a schematic cross-sectional view showing the structure of a projector, which is an example of an electronic apparatus incorporating an electro-optical device.

First, a projector incorporating a liquid-crystal device serving as a light valve, the liquid-crystal device being the above-described electro-optical device, will be described. FIG. 11 is a schematic cross-sectional view showing the structure of the projector. As illustrated, a projector 1100 includes a lamp unit 1102 incorporating a white light source such as a halogen lamp. Light projected from the lamp unit 1102 is divided into the three primary colors RGB by four mirrors 1106 and two dichroic mirrors 1108 in a light guide 1104. The light of the three primary colors enters a liquid-crystal device 1110R, a liquid-crystal device 1110G, and a liquid-crystal device 1110B, respectively, that serve as light valves corresponding to each of the primary colors. The configuration of each of the liquid-crystal device 1110R, the liquid-crystal device 1110G, and the liquid-crystal device 1110B is identical to the above-described electro-optical device, in which signals for the primary colors, R, G, and B supplied from an image-signal processing circuit are modulated. The beams of light modulated by these liquid-crystal devices enter a dichroic prism 1112 from three directions. In the dichroic prism 1112, the light of R and B is refracted at an angle of 90 degrees, while the light of G travels in a straight line. Thus, images in each color are generated and color images are projected through a projection lens 1114, for example, onto a screen.

(Mobile Computer)

Figure 12:
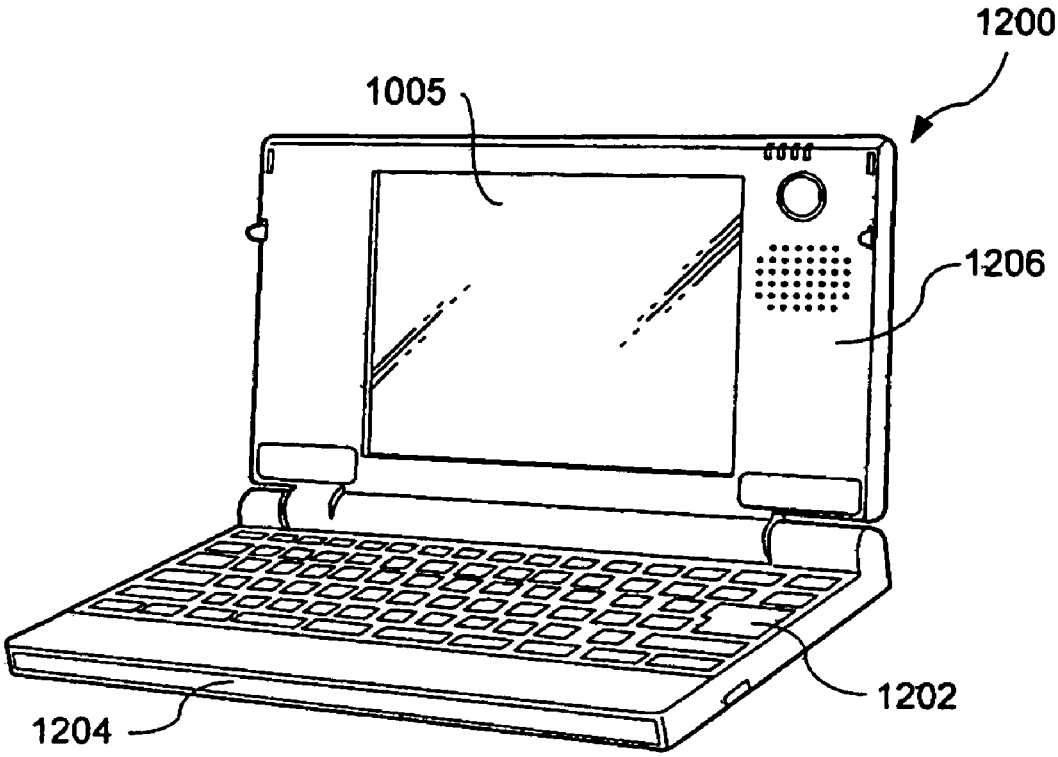
FIG. 12 is a schematic perspective view showing the structure of a personal computer, which is an example of an electronic apparatus incorporating an electro-optical device.

Next, a mobile computer incorporating the liquid-crystal device, which is the above-described electro-optical device, will be described. FIG. 12 is a schematic perspective view showing the structure of a personal computer. A personal computer 1200 has a main body 1204 including a keyboard 1202, and a liquid-crystal-display section 1206 including the liquid-crystal device 1005, which is the above-described electro-optical device, provided with a backlight.

(Mobile Phone)

Figure 13:
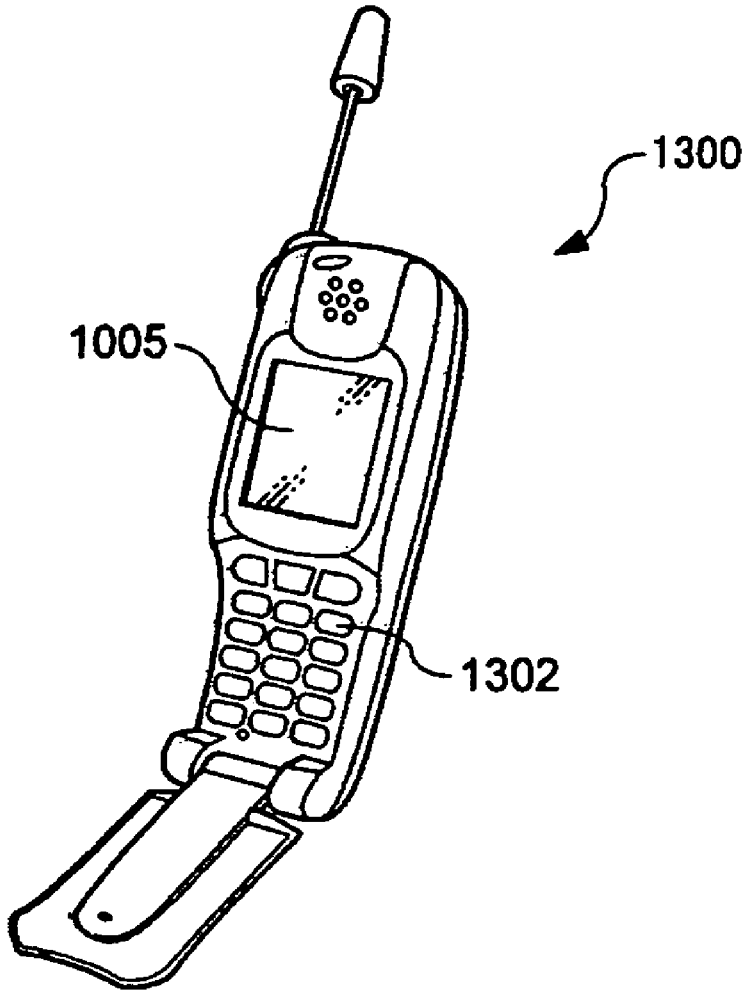
FIG. 13 is a schematic perspective view showing the structure of a mobile phone, which is an example of an electronic apparatus incorporating an electro-optical device.

Furthermore, a mobile phone incorporating the liquid-crystal device, which is the above-described electro-optical device, will be described. FIG. 13 is a schematic perspective view showing the structure of a mobile phone. In the drawing, a mobile phone 1300 includes a plurality of operation buttons 1302 as well as a reflective liquid-crystal device 1005, which is the above-described electro-optical device. The reflective liquid-crystal device 1005 is provided with a front light on the front, if needed.

Examples of the electro-optical device according to exemplary embodiments of the present invention, other than the liquid-crystal device described above, include an electrophoresis unit such as electronic paper, and a field emission display and a surface-conduction electron-emitter display that include electron-emitting elements. In addition, the electro-optical device of exemplary embodiments of the present invention is applicable to, other than to the electronic apparatus described above, a television receiver, a viewfinder-type or monitor-direct-view-type videotape recorder, a car-navigation system, a pager, an electronic notepad, a calculator, a word processor, a workstation, a videophone, a POS terminal, and a system with a touch panel.

The present invention is not limited to the above-described exemplary embodiments, but certain exemplary modifications may be practiced within the concepts and ideas that can be understood from the entire claims and specification. Therefore, such modifications of the electro-optical device and the electronic apparatus are also within the technical scope of the present invention.

What is claimed is:

1. An electro-optical device, comprising:

a plurality of scanning lines and a plurality of data lines intersecting each other in an image display area;

a plurality of pixels connected to the plurality of scanning lines and the plurality of data lines;

n-number of image-signal lines to which image signals are supplied, n being a number greater than or equal to 2, the image-signal lines being located in a peripheral area that is peripheral to the image display area;

a sampling circuit in the peripheral area, the sampling circuit including thin-film transistors corresponding to the respective data lines, the thin-film transistors including a first group of n thin-film transistors connected to n data lines and a second group of n thin-film transistors connected to a different n data lines, the first group and the second group being located adjacent to each other and separated by a space therebetween, the thin-film transistors each including:

i) a drain connected to a drain line extending from the data line in the extending direction of the data line;

ii) a source connected to a source line extending from the image-signal line in the extending direction of the data line; and iii) a gate interposed between the drain line and the source line, and extending in the extending direction of the data line;

a data-line driving circuit to supply sampling-circuit driving signals to the gates of the thin-film transistors in the sampling circuit, data-line driving circuit simultaneously driving n data lines at a time by first supplying sampling-circuit driving signals to the gates in the first group and subsequently to the gates of the thin-film transistors in the second group; and an electromagnetic shield disposed entirely between thin-film transistors of the first group and thin-film transistors of the second group in the sampling circuit, no electromagnetic shield disposed in between any other parts of the thin-film transistors in either the first group or the second group.

2. The electro-optical device according to claim 1, the source line, the drain line, and the electromagnetic shield being formed of the same conductive layer disposed in a laminated structure on the substrate.

3. The electro-optical device according to claim 1, the source line and the drain line being formed of the same first conductive layer disposed in a laminated structure on the substrate; and the electromagnetic shield in the laminated structure having a portion formed of a second conductive layer disposed on the first conductive layer with an insulating interlayer interposed therebetween.

4. The electro-optical device according to claim 3, the electromagnetic shield at least partially covering the source line and the drain line from above the insulating interlayer.

5. The electro-optical device according to claim 3, the insulating interlayer being provided with a depression isolated from the source line and the drain line, the second conductive layer also being formed in the depression.

6. The electro-optical device according to claim 1, the source line and the drain line being formed of the same first conductive layer disposed in a laminated structure on the substrate; and the electromagnetic shield in the laminated structure having a portion formed of a second conductive layer disposed under the first conductive layer with insulating interlayers interposed therebetween.

7. The electro-optical device according to claim 1, the electromagnetic shield being connected to lines of constant potential.

8. The electro-optical device according to claim 7, the lines of constant potential including a line of ground potential supplied to the data-line driving circuit.

9. The electro-optical device according to claim 1, the electromagnetic shield being connected to lines of variable potential periodically changing in response to timing of inversion driving.

10. The electro-optical device according to claim 1, the electromagnetic shield being connected to the gate.

11. The electro-optical device according to claim 1, the electromagnetic shield between the two adjacent thin-film transistors being formed in a position for at least partially blocking the shortest electric line of force connecting the source line to the drain line adjacent to each other.

12. An electronic apparatus, comprising:

an electro-optical device that includes:

a plurality of scanning lines and a plurality of data lines intersecting with each other in an image display area;

a plurality of pixels connected to the plurality of scanning lines and the plurality of data lines;

n-number of image-signal lines to which image signals are supplied, n being a number greater than or equal to 2, the image-signal lines being located in a peripheral area that is peripheral to the image display area;

a sampling circuit in the peripheral area, the sampling circuit including thin-film transistors corresponding to the respective data lines, the thin-film transistors including a first group of n thin-film transistors connected to n data lines and a second group of n thin-film transistors connected to a different n data lines, the first group and the second group being located adjacent to each other and separated by a space therebetween, the thin-film transistors each including:

i) a drain connected to a drain line extending from the data line;

ii) a source connected to a source line extending from the image-signal line in the extending direction of the data line; and iii) a gate interposed between the drain line and the source line, and extending in the extending direction of the data line;

a data-line driving circuit to supply sampling-circuit driving signals to the gates of the thin-film transistors in the sampling circuit, data-line driving circuit simultaneously driving n data lines at a time by first supplying sampling-circuit driving signals to the gates in the first group and subsequently to the gates of the thin-film transistors in the second group; and an electromagnetic shield disposed entirely between thin-film transistors of the first group and thin-film transistors of the second group in the sampling circuit, no electromagnetic shield disposed in between any other parts of the thin-film transistors in either the first group or the second group.

13. An electro-optical device, comprising:

a substrate;

a plurality of scanning lines and a plurality of data lines intersecting each other in an image display area on the substrate;

a plurality of pixels connected to the plurality of scanning lines and the plurality of data lines;

a plurality of image-signal lines to which image signals are supplied, the image-signal lines being located in a peripheral area of the image display area on the substrate;

a sampling circuit in the peripheral area, the sampling circuit including a plurality of thin-film transistors corresponding to the respective data lines, the thin-film transistors each including:

i) a drain connected to a drain line extending from the data line in the extending direction of the data line;

ii) a source connected to a source line extending from the image-signal line in the extending direction of the data line; and iii) a gate interposed between the drain line and the source line, and extending in the extending direction of the data line;

a data-line driving circuit to supply sampling-circuit driving signals to the gate; and an electromagnetic shield disposed entirely between thin-film transistors of the first group and thin-film transistors of the second group in the sampling circuit, no electromagnetic shield disposed in between any other parts of the thin-film transistors in either the first group or the second group;

the source line and the drain line being formed of the same first conductive layer disposed in a laminated structure on the substrate; and the electromagnetic shield in the laminated structure having a first portion formed of a second conductive layer disposed on the first conductive layer with an insulating interlayer interposed therebetween and a second portion formed of a conductive material disposed in a convex part of the insulating interlayer.

14. An electro-optical device according to claim 13, the convex part is a hole that is circular or rectangular in plan view.

15. An electro-optical device according to claim 13, the convex part is a long slot or groove.

* * * * *